US008568558B2

(12) United States Patent
Dietz

(10) Patent No.: US 8,568,558 B2
(45) Date of Patent: Oct. 29, 2013

(54) PROCESS FOR DELIGNIFYING AND BLEACHING CHEMICAL PULP

(75) Inventor: Thomas Dietz, Haibach (DE)

(73) Assignee: Evonik Degussa GmbH, Essen (DE)

( * ) Notice: Subject to any disclaimer, the term of this patent is extended or adjusted under 35 U.S.C. 154(b) by 298 days.

(21) Appl. No.: 13/007,664

(22) Filed: Jan. 16, 2011

(65) Prior Publication Data

US 2011/0174451 A1 Jul. 21, 2011

Related U.S. Application Data

(60) Provisional application No. 61/297,754, filed on Jan. 23, 2010.

(30) Foreign Application Priority Data

Jan. 19, 2010 (DE) ..... 10 2010 001 001

(51) Int. Cl.
*D21C 9/16* (2006.01)
*D21C 9/14* (2006.01)

(52) U.S. Cl.
USPC ..... 162/78; 162/79; 162/87; 162/88

(58) Field of Classification Search
CPC ..... D21C 9/144; D21C 9/163; D21C 9/1063
USPC ..... 162/74, 78, 79, 87
See application file for complete search history.

(56) References Cited

U.S. PATENT DOCUMENTS

| | | | |
|---|---|---|---|
| 3,835,001 | A | 9/1974 | O'Brien |
| 4,065,475 | A | 12/1977 | Hosoi et al. |
| 4,401,631 | A | 8/1983 | Canavesi et al. |
| 4,427,490 | A | 1/1984 | Eckert |
| 5,667,694 | A | 9/1997 | Cody et al. |
| 6,048,437 | A | 4/2000 | Fukushima et al. |
| 6,432,266 | B1 | 8/2002 | Fukushima et al. |
| 6,660,128 | B1 | 12/2003 | Bourbonnais et al. |
| 7,250,106 | B2 | 7/2007 | Benazzi et al. |
| 2003/0019596 | A1 | 1/2003 | Ragauskas et al. |
| 2007/0079944 | A1 | 4/2007 | Amidon et al. |
| 2009/0274598 | A1 | 11/2009 | Dietz et al. |

FOREIGN PATENT DOCUMENTS

| | | | |
|---|---|---|---|
| CA | 1 129 161 | | 8/1982 |
| CZ | 279 703 | | 6/1995 |
| DE | 44 46 122 | A1 | 6/1996 |
| EP | 0 765 842 | A1 | 4/1997 |
| GB | 2 065 628 | A | 7/1981 |
| JP | 61-261215 | | 11/1986 |
| JP | 6-10089 | | 1/1994 |
| JP | 11-130762 | | 5/1999 |
| JP | 2003-48716 | | 2/2003 |
| RU | 1836465 | A3 | 8/1993 |
| RU | 2 176 677 | C2 | 12/2001 |
| WO | WO 96/01921 | | 1/1996 |
| WO | WO 96/37654 | | 11/1996 |
| WO | WO 2009/108111 | | 9/2009 |
| WO | WO 2009/133053 | | 11/2009 |

OTHER PUBLICATIONS

Milagres et al., Bleaching eucalyptus with short sequences, 2007, Proceedings 3rd ICEP—International Colloquium on Eucalyptus Pulp.*
Milagres et al., Bleaching eucalyptus with short sequences, translation of, google: Feb. 7, 2013.*
Eucalyptus Online book, Sep. 2012.*
European Search Report for EP 10 19 7066 dated Jun. 17, 2011.
English language translation of sections 2.1, 2.2, 2,3 and 3 from the European Search Report for EP 10 19 7066, 2011.
Atia, "Adsorption of chromate and molybdate by cetylpyridinium bentonite," *Applied Clay Science 41*:73-84 (2008).
Database WPI Week 200165; Thomson Scientific, London, GB; AN 2001-577936; XP002540018.
Kubelka, et al., "Delignification with Acidic Hydrogen Peroxide Activated by Molybdate," *Journal of Pulp Paper and Science 18*(3):J108-J114 (May 1992).
Manning, et al., "Addition of Hydrogen Peroxide and Molybdate to Chlorine Dioxide Bleaching Stages," *Journal of Pulp Paper and Science32*(2):58-62 (2006).
Sameer, et al., "Recovery of Catalytic Molybdate from Dilute Solutions," In the proceedings of the 93rd annual conference of the PATPTAC, pp. A261-A268 (2007).
English language abstract for CZ 279 703, 1995.
English language abstract for DE 44 46 122, 1996.
English language abstract for JP 61-261215, 1986.
English language abstract for JP 6-10089, 1984.
English language abstract for JP 11-130762, 1999.
English language abstract for JP 2003-48716, 2003.
English language abstract for SU 1836465, 1993.
Certified English Translation of DE 44 46 122, 2009.

* cited by examiner

*Primary Examiner* — Anthony Calandra
(74) *Attorney, Agent, or Firm* — Law Office of: Michael A. Sanzo, LLC

(57) ABSTRACT

The delignification and bleaching of chemical pulp by a bleaching stage, in which the chemical pulp is reacted first with chlorine dioxide and, after reaction of the chlorine dioxide, is further reacted without intermediate washing with hydrogen peroxide in the presence of a molybdate or tungstate, permits the production of chemical pulp having a whiteness of at least 89.5%, having improved stability to yellowing and reduced oxidative damage.

16 Claims, No Drawings

PROCESS FOR DELIGNIFYING AND BLEACHING CHEMICAL PULP

CROSS REFERENCE TO RELATED APPLICATIONS

The present application claims the benefit of U.S. provisional application 61/297,754 filed on Jan. 23, 2010 and priority to German Application DE 10 2010 001 001.4 filed on Jan. 19, 2010.

FIELD OF THE INVENTION

The invention relates to a process for delignifying and bleaching chemical pulp with chlorine dioxide and hydrogen peroxide in the presence of a molybdate or tungstate as a catalyst.

BACKGROUND OF THE INVENTION

For the production of paper, chemical pulp must be delignified and bleached after cooking of pulp in a plurality of stages. Whereas in the past mainly elemental chlorine was used for delignifying and bleaching, bleaching sequences without elemental chlorine are now used in the ECF bleach. The bleaching sequence O-$D_0$-$E_{OP}$-$D_1$-P is most frequently used for this purpose, O representing a delignification with oxygen under alkaline conditions, $D_0$ and $D_1$ designating first and second stages with chlorine dioxide as a bleaching and delignifying agent, $E_{OP}$ representing an alkaline extraction with addition of oxygen and hydrogen peroxide, P designating bleaching with hydrogen peroxide and each hyphen representing washing of the chemical pulp, for example by addition of water and filtration of the resulting suspension.

For the further development of the ECF bleach, a reduction of the amount of chlorine dioxide used is strived for in order further to reduce the formation of organochlorine compounds during the bleaching of the chemical pulp. Moreover, a simplification of the bleaching sequence with a reduction of the number of stages to only four stages and three washes in between is strived for in order to be able to carry out the ECF bleach with the same number of stages as bleaching of chemical pulp with elemental chlorine. However, the same whiteness of at least 89.5% ISO (according to PAPTAC standard E.1) and the same stability of the whiteness must be achieved as with the bleaching sequence O-$D_0$-$E_{OP}$-$D_1$-P, and there must be no greater oxidative degradation of the chemical pulp.

U.S. Pat. No. 6,048,437 describes a process for delignifying and bleaching chemical pulp with a bleaching sequence O-$DP_{cat}$-$E_{OP}$-$D_1$-P, in which, instead of a first stage $D_0$ for delignifying and bleaching with chlorine dioxide, a stage $DP_{cat}$ is used in which the chlorine dioxide and hydrogen peroxide are used simultaneously in the presence of a molybdate or tungstate as a catalyst. Compared with the $D_0$ stage of the conventional ECF bleach, the process permits a reduction of the required amount of chlorine dioxide but the desired whiteness of at least 89.5% ISO is not achieved with the amounts of chlorine dioxide and hydrogen peroxide used in U.S. Pat. No. 6,048,427. If the amounts of chlorine dioxide and hydrogen peroxide are increased, an undesirable oxidative degradation of the chemical pulp takes place, which is noticeable from a decrease in the viscosity of the chemical pulp, as is known from M. S. Manning et al., J. Pulp Paper Sci. 32 (2006) 58-62. Such an undesired degradation of the chemical pulp can be avoided only by introducing an additional stage Q of extraction of the chemical pulp with a metal ion chelating agent, corresponding to a bleaching sequence O-Q-$DP_{cat}$-$E_{OP}$-$D_1$-P or Q-O-$DP_{cat}$-$E_{OP}$-$D_1$-P. U.S. Pat. No. 6,048,437 also describes in comparative examples 13 and 14, that two stages D-$P_{cat}$ or $P_{cat}$-D, in which $P_{cat}$ represents bleaching with hydrogen peroxide in the presence of a molybdate or tungstate as a catalyst, provide substantially less bleaching effect compared with the $DP_{cat}$ stage.

DESCRIPTION OF THE INVENTION

It has now surprisingly been found that, with a bleaching stage D/$P_{cat}$, in which the chemical pulp is reacted first with chlorine dioxide and, after consumption of the chlorine dioxide, is reacted further with hydrogen peroxide in the presence of a molybdate or tungstate without an intermediate washing, a further improved bleaching effect and a further saving of chlorine dioxide are achieved compared with the bleaching stage $DP_{cat}$ disclosed in U.S. Pat. No. 6,048,437, without there being any undesired degradation of the chemical pulp, so that an additional stage Q of an extraction of the chemical pulp with an agent which chelates metal ions can be dispensed with.

The invention therefore relates to a process for delignifying and bleaching chemical pulp, comprising a bleaching stage in which in a first step chemical pulp is reacted in an aqueous mixture, containing 3 to 30% by weight of chemical pulp, with chlorine dioxide in an amount corresponding to a Kappa factor in the range from 0.02 to 0.25 at a temperature of 50 to 150° C. and a pH in the range from 2 to 7 until more than 90% of the chlorine dioxide has reacted and the mixture obtained in the first step is then further reacted, without separating off constituents of the mixture, in a second step with 0.1 to 5% by weight of hydrogen peroxide in the presence of a molybdate in an amount of 10 to 2000 ppm of molybdenum or of a tungstate in an amount of 200 to 10 000 ppm of tungsten at a temperature of 50 to 150° C., the amounts being based in each case on the mass of dry chemical pulp used.

The process according to the invention comprises a bleaching stage having two steps. In the first step, chemical pulp is reacted with chlorine dioxide until more than 90%, preferably more than 95% and particularly preferably more than 99% of the chlorine dioxide has reacted. In the most preferred embodiment, the chlorine dioxide is completely reacted in the first step. After the first step, the mixture obtained in the first step is then reacted, without separating off constituents of the mixture, in a second step with hydrogen peroxide in the presence of a molybdate or a tungstate.

In the first step of the bleaching stage of the process according to the invention, the chemical pulp is reacted with chlorine dioxide at a consistency in the range from 3 to 30%, i.e. the reaction takes place in an aqueous mixture having a content of 3 to 30% by weight of chemical pulp, calculated as dry chemical pulp, based on the total mass of the aqueous mixture. Preferably, the consistency is in the range from 5 to 20% and particularly preferably in the range from 8 to 15%. Chlorine dioxide is used in an amount corresponding to a Kappa factor in the range from 0.02 to 0.25 and preferably in the range from 0.05 to 0.15. The Kappa factor is a parameter, familiar to the person skilled in the art, for the amount of bleach used for bleaching the chemical pulp and designates the quotient of the amount of bleach, calculated as active chlorine concentration in % by weight, based on the mass of dry chemical pulp, and the Kappa number of the chemical pulp used. The active chlorine content is calculated from the concentration of chlorine dioxide in % by weight, based on the mass of dry chemical pulp, by multiplication by the factor 2.63, i.e. a concentration of chlorine dioxide of 1% by weight corresponds to an active chlorine concentration of 2.63% by weight. When the chemical pulp used has a Kappa number of 10, a concentration of 0.5% by weight of chlorine dioxide accordingly corresponds to a Kappa factor of 0.5*2.63/10=0.1315. The Kappa number is a parameter, known to the person skilled in the art, for the lignin content of the chemical pulp, which is determined via the consumption of permanganate for the oxidation of residual lignin according to TAPPI standard T 236 om 99.

In the first step of the bleaching stage of the process according to the invention, the chemical pulp is reacted with chlorine dioxide at a temperature of 50 to 150° C., preferably of 60 to 120° C. and particularly preferably of 70 to 90° C. The reaction takes place at a pH of the aqueous mixture in the range from 2 to 7, preferably 2 to 5 and particularly preferably 2 to 4. The pH of the aqueous mixture is preferably adjusted by addition of an inorganic acid, particularly preferably by addition of sulfuric acid or hydrochloric acid. The reaction time required for reacting the chlorine dioxide depends on the reaction temperature and the concentration of chlorine dioxide and is preferably 5 to 30 min and particularly preferably 10 to 20 min. At a reaction temperature of 90° C., complete reaction of the chlorine dioxide is normally achieved within 15 min for a Kappa factor in the range from 0.05 to 0.15.

In the second step of the bleaching stage of the process according to the invention, the chemical pulp is reacted with hydrogen peroxide in an amount of 0.1 to 5% by weight of hydrogen peroxide, based on the mass of dry chemical pulp used. Preferably 0.2 to 2% by weight and particularly preferably 0.5 to 1% by weight of hydrogen peroxide are used. For this purpose, a corresponding amount of hydrogen peroxide, preferably in the form of an aqueous solution having a content of 35 to 70% by weight of hydrogen peroxide, is added to the mixture obtained in the first step of the bleaching stage. The reaction with hydrogen peroxide takes place in the presence of a molybdate or a tungstate which acts as a catalyst for the bleaching with hydrogen peroxide. According to the invention, the terms molybdate and tungstate comprise both mononuclear molybdates and tungstates, such as $MoO_4^{2-}$ or $WO_4^{2-}$, and polynuclear molybdates and tungstates, such as $Mo_7O_{24}^{6-}$, $Mo_8O_{26}^{4-}$, $HW_6O_{21}^{5-}$, $W_{12}O_{41}^{10-}$ or $W_{12}O_{39}^{6-}$, and polynuclear molybdates and tungstates containing heteroatoms, such as $PMo_{12}O_{40}^{3-}$, $SiMo_{12}O_{40}^{3-}$, $PW_{12}O_{40}^{3-}$ or $SiW_{12}O_{40}^{3-}$. With the use of molybdate as a catalyst, the molybdate is employed in an amount of 10 to 2000 ppm, preferably 100 to 1500 ppm and particularly preferably 200 to 600 ppm of molybdenum, based on the mass of dry chemical pulp. With the use of tungstate as a catalyst, the tungstate is employed in an amount of 200 to 10 000 ppm, preferably 500 to 5000 ppm and particularly preferably 1500 to 3000 ppm of tungsten, based on the mass of dry chemical pulp.

The molybdate or tungstate used as a catalyst can be added to the mixture obtained in the first step, before or after the hydrogen peroxide, or simultaneously with the hydrogen peroxide. Alternatively, the molybdate or tungstate may already have been added in the first step of the bleaching stage before or after the chlorine dioxide or simultaneously with the chlorine dioxide. In a preferred embodiment, the molybdate or tungstate and the hydrogen peroxide are added in the second step simultaneously but separate from one another in the form of two aqueous solutions.

In the second step of the bleaching stage of the process according to the invention, the reaction of the chemical pulp with hydrogen peroxide takes place at a temperature of 50 to 150° C., preferably of 60 to 120° C. and particularly preferably of 70 to 90° C. Preferably, the first and the second step of the bleaching stage are carried out at the same temperature. The reaction of the chemical pulp with hydrogen peroxide takes place in the second step preferably for a duration of 60 to 180 min, particularly preferably 90 to 120 min. Reaction temperature, reaction time and the amount of molybdate or tungstate used as a catalyst are preferably chosen so that in the second step more than 90%, preferably more than 95% and particularly preferably more than 99% of the hydrogen peroxide used is reacted.

In the second step of the bleaching stage of the process according to the invention, the reaction of the chemical pulp with hydrogen peroxide is preferably carried out in the same pH range as the reaction with chlorine dioxide in the first step. If required, further acid is added for adjusting the pH. As rule, however, no further adjustment of the pH is required after the first step.

The bleaching stage of the process according to the invention can be carried out in the apparatuses known from the prior art for delignifying and bleaching chemical pulp with chlorine dioxide and hydrogen peroxide.

Preferably, the bleaching stage is carried out continuously in an apparatus comprising a riser tube and a bleaching tower, in which the upper end of the riser tube is connected to the upper end of the bleaching tower. The aqueous mixture containing 3 to 30% by weight of chemical pulp is fed to the riser tube at the lower end. Chlorine dioxide is added to the mixture in the lower region of the riser tube and, after addition of the chlorine dioxide, the mixture flows through the riser tube in an ascending flow within 5 to 30 min so that the first step of the bleaching stage takes place in the riser tube. The resulting mixture is withdrawn from the riser tube at the top and is fed to the bleaching tower at the top. Hydrogen peroxide is added to the mixture in an upper region of the riser tube or at the top of the bleaching tower and, after addition of the hydrogen peroxide, the mixture flows through the bleaching tower in a descending flow within 60 to 180 min so that the second step of the bleaching stage takes place in the bleaching tower. In this embodiment, the bleaching stage of the process according to the invention can be carried out in a typical bleaching tower for bleaching chemical pulp with a minimum of alterations of the apparatus, so that an existing plant for bleaching chemical pulp can be converted with little effort for carrying out the process according to the invention.

In a preferred embodiment, the process according to the invention comprises, in addition to the bleaching stage, an extraction of the chemical pulp with an aqueous alkaline solution following the bleaching stage, and a subsequent additional bleaching stage in which, in a first step, the chemical pulp is reacted in an aqueous mixture containing 3 to 30% by weight of chemical pulp with 0.04 to 0.4% by weight of chlorine dioxide, based on the mass of dry chemical pulp used, at a temperature of 50 to 150° C. and a pH in the range from 2 to 7 until at least 90% of the chlorine dioxide used has reacted and the mixture obtained in the first step is further reacted, without separating off constituents of the mixture, in a second step with 0.1 to 5% by weight of hydrogen peroxide, based on the mass of dry chemical pulp used, at a temperature of 50 to 150° C. and a pH in the range from 10 to 12.5.

In this preferred embodiment, the extraction of the chemical pulp with an aqueous alkaline solution can be carried out in the same manner as the alkaline extraction used in the known ECF bleaching sequences after a $D_0$ bleaching stage. Preferably, the extraction is effected with addition of oxygen as an $E_O$ stage, with addition of hydrogen peroxide as an $E_P$ stage or with addition of both oxygen and hydrogen peroxide as an $E_{OP}$ stage. Between the bleaching stage according to the invention and the extraction of the chemical pulp with an aqueous alkaline solution and between the extraction of the chemical pulp with an aqueous alkaline solution and the additional bleaching stage, washing of the chemical pulp is preferably carried out in order to reduce the consumption of alkali in the extraction and the consumption of acid in the additional bleaching stage and in order to remove compounds split from the chemical pulp in the bleaching stage and the extraction.

In the additional bleaching stage, in a first step, the chemical pulp is reacted in an aqueous mixture once again with chlorine dioxide at a pH in the range from 2 to 7 until more than 90%, preferably more than 95% and particularly preferably more than 99% of the chlorine dioxide have reacted. Most preferably, the chlorine dioxide is reacted completely in the first step. After the first step, the mixture obtained in the first step is then reacted, without separating off constituents of the mixture, in a second step with hydrogen peroxide at a pH in the range from 10 to 12.5.

In the first step of the additional bleaching stage, the reaction of the chemical pulp with chlorine dioxide takes place at a consistency in the range from 3 to 30%, i.e. the reaction takes place in an aqueous mixture having a content of 3 to 30% by weight of chemical pulp, calculated as dry chemical pulp, based on the total mass of the aqueous mixture. Preferably, the consistency is in the range from 5 to 20% and particularly preferably in the range from 8 to 15%. Chlorine dioxide is used in an amount of 0.04 to 0.4% by weight of chlorine dioxide, preferably 0.08 to 0.2% by weight of chlorine dioxide, based on the amount of dry chemical pulp used.

In the first step of the additional bleaching stage, the reaction of the chemical pulp with chlorine dioxide takes place at a temperature of 50 to 150° C., preferably of 60 to 120° C. and particularly preferably of 70 to 90° C. The reaction takes place at a pH of the aqueous mixture in the range from 2 to 7, preferably 3 to 6 and particularly preferably 4 to 6. The pH of the aqueous mixture is preferably adjusted by addition of an inorganic acid, particularly preferably by addition of sulfuric acid or hydrochloric acid. The reaction time required for the reaction of the chlorine dioxide depends on the reaction temperature and the concentration of chlorine dioxide and is preferably 5 to 30 min and particularly preferably 10 to 20 min.

In the second step of the additional bleaching stage, the reaction of the chemical pulp with hydrogen peroxide takes place at a pH in the range from 10 to 12.5, preferably 11 to 12. For this purpose, the pH of the aqueous mixture is preferably adjusted by addition of an inorganic base, particularly preferably by addition of sodium hydroxide solution, calcium hydroxide or magnesium hydroxide. Hydrogen peroxide is used in an amount of 0.1 to 5% by weight, based on the mass of dry chemical pulp employed. Preferably, 0.2 to 2% by weight and particularly preferably 0.25 to 1% by weight of hydrogen peroxide are used. Hydrogen peroxide is preferably added in the form of an aqueous solution having a content of 35 to 70% by weight of hydrogen peroxide. When using calcium hydroxide or magnesium hydroxide, the addition of hydrogen peroxide is preferably made after the addition of the base. When using sodium hydroxide solution, the hydrogen peroxide is preferably added simultaneously with the sodium hydroxide solution, but separately from it.

In the second step of the additional bleaching stage, the reaction of the chemical pulp with hydrogen peroxide takes place at a temperature of 50 to 150° C., preferably of 60 to 120° C. and particularly preferably of 70 to 90° C. Preferably, the first and the second step of the bleaching stage are carried out at the same temperature. In the second step, the reaction of the chemical pulp with hydrogen peroxide preferably takes place for a duration of 60 to 180 min, particularly preferably 90 to 120 min.

Preferably, the additional bleaching stage is carried out in an apparatus comprising a riser tube and a bleaching tower in the same manner as described above for the bleaching stage.

The preferred embodiment comprising the additional bleaching stage according to the invention has the advantage that a bleaching stage and a wash can be saved compared to the bleaching stage sequence having the final stages $D_1$-P used in the customary ECF bleach and in U.S. Pat. No. 6,048,437. In the preferred embodiment with washes before and after the alkaline extraction, the bleaching sequence $D/P_{cat}$-E-D/P results for the embodiment with the additional bleaching stage according to the invention, D/P representing the additional bleaching stage according to the invention, or the bleaching sequences $D/P_{cat}$-$E_O$-D/P, $D/P_{cat}$-$E_P$-D/P and $D/P_{cat}$-$E_{OP}$-D/P representing the embodiments of the alkaline extraction with addition of oxygen and/or hydrogen peroxide.

In the process according to the invention, it is preferred to carry out a delignification of the chemical pulp in a stage O with oxygen under alkaline conditions, particularly preferably under pressure, prior to the bleaching stage $D/P_{cat}$ according to the invention. All processes which are known from the prior art for delignifying chemical pulp with oxygen can be used for this purpose. The preferred embodiment comprising the additional bleaching stage according to the invention then results in the bleaching sequences O-$D/P_{cat}$-E-D/P, O-$D/P_{cat}$-$E_O$-D/P and O-$D/P_{cat}$-$E_{OP}$-D/P according to the invention.

In a further preferred embodiment, the process according to the invention additionally comprises a recovery of molybdate or tungstate according to the teaching of WO 2009/133053. In this embodiment, an aqueous solution containing molybdate or tungstate is separated from the mixture resulting in the second step of the bleaching stage $D/P_{cat}$ and molybdate or tungstate is separated off from this solution by the steps bringing the solution into contact with a water-insoluble, cationized inorganic support material at a pH in the range between 2 and 6 to give a support material laden with molybdate or tungstate and an aqueous solution depleted in molybdate or tungstate, separating the support material laden with molybdate or tungstate from the aqueous solution depleted in molybdate or tungstate, bringing the support material laden with molybdate or tungstate into contact with an aqueous solution at a pH in the range between 6 and 14 to give a support material depleted in molybdate or tungstate and an aqueous solution laden with molybdate or tungstate and separating the support material depleted in molybdate or tungstate from the aqueous solution laden with molybdate or tungstate. The aqueous solution separated off in the last step and laden with molybdate or tungstate is then recycled into the second step of the bleaching stage.

Preferably, the cationized inorganic support material used is a cationized phyllosilicate, particularly preferably a bentonite ion-exchanged with a quaternary ammonium salt. In addition, all preferred embodiments described in WO 2009/133053 for the recovery steps can be used for recovering molybdate or tungstate.

In the process according to the invention, a complexing agent can additionally be used together with the hydrogen peroxide in the bleaching stage $D/P_{cat}$ according to the invention and/or in the additional stage D/P according to the invention. All complexing agents known from the prior art for reducing the decomposition of hydrogen peroxide in bleaching of chemical pulp can be used for this purpose. Aminocarboxylic acids or aminophosphonic acids, such as, for example, ethylenediaminetetraacetic acid (EDTA), diethylene-triaminepentaacetic acid (DTPA), N-hydroxyethyl-N,N',N'-triacetic acid, cyclohexanediaminetetraacetic acid, amino-trimethylenephosphonic acid, ethylenediaminetetramethylene-phosphonic acid, diethylenetriaminepentamethylenephosphonic acid, propylenediaminetetramethylenephosphonic acid or dipropylenetriaminepentamethylenephosphonic acid, and salts thereof, are preferably used as complexing agents. Particularly preferred complexing agents are EDTA and DTPA and the sodium salts thereof. The complexing agents are preferably used in an amount of 0.05 to 1% by weight, based on the mass of dry chemical pulp used.

The following examples illustrate the claimed process, but without limiting the subject matter of the invention.

EXAMPLES

Methods:

The Kappa number of the chemical pulp was determined according to TAPPI standard T 236 om 99. The whiteness of the chemical pulp was determined according to PAPTAC standard E.1. The determination of the loss of whiteness by heat ageing and of the post color number was carried out by the TAPPI UM 200 and TAPPI T 260 methods. The viscosity of the chemical pulp was determined according to TAPPI standard T 236 om 99.

All experiments were carried out using eucalyptus kraft pulps which was delignified with oxygen under alkaline conditions. The Kappa number and the whiteness of the chemical pulps used are mentioned in table 1.

The bleaching stages were each carried out at a consistency of 10% by mixing the chemical pulp with the corresponding amount of water and the amounts of bleaching chemicals stated in the examples and keeping it in a plastic bag in a thermostated water bath at the temperature stated in the example. Deviating therefrom, the alkaline oxygen reinforced extraction $E_{OP}$ in examples 25 and 26 was carried out in a rotating autoclave at an oxygen pressure of 3 bar. The stated amounts of bleaching chemicals are based on the mass of the dry chemical pulp used in the bleaching sequence. For the catalyzed bleaching with hydrogen peroxide, sodium molybdate in the form of an aqueous solution was used as the catalyst.

The washes between the bleaching stages were effected in each case by addition of demineralized water to a consistency of 2%, thorough stirring of the suspension obtained and separation of the chemical pulp from this suspension by vacuum filtration and centrifuging.

TABLE 1

Kappa number and whiteness of the chemical pulps used

| Chemical pulp | Used in experiments | Kappa number | Whiteness in % ISO |
|---|---|---|---|
| A | 1-6 | 10.0 | 50.1 |
| B | 7-15 | 10.5 | 56.9 |
| C | 16, 17 | 10.3 | 56.6 |
| D | 18-21 | 10.3 | 52.3 |
| E | 22-25 | 10.3 | 55.1 |
| F | 26, 27 | 12.9 | 47.9 |

Comparison of Bleaching Stages:

In examples 1 to 5, chemical pulp A was bleached with the amounts of chemicals mentioned in table 2 under the conditions mentioned in the table. Table 2 also shows the Kappa number and the whiteness of the chemical pulp after bleaching.

In example 1, according to the invention first only chlorine dioxide and sulfuric acid were added, and hydrogen peroxide and sodium molybdate were added only after 15 min. At the time of addition of hydrogen peroxide, all chlorine dioxide had reacted. At the end of the bleaching stage, 34% of the charged hydrogen peroxide could be detected.

In example 2 (not according to the invention), chlorine dioxide, sulfuric acid, hydrogen peroxide and sodium molybdate were added simultaneously according to the teaching of U.S. Pat. No. 6,048,437. At the end of the bleaching stage, 11% of the charged hydrogen peroxide could be detected.

In example 3 (not according to the invention), the sequence of addition of chlorine dioxide and hydrogen peroxide was reversed compared with the bleaching stage according to the invention, i.e. first sulfuric acid, hydrogen peroxide and sodium molybdate were added and chlorine dioxide was added only after 120 min. At the end of the bleaching stage, the charged hydrogen peroxide was completely reacted.

In examples 4 and 5 (not according to the invention), bleaching was carried out without chlorine dioxide or without hydrogen peroxide, and in example 6 (not according to the invention) only sulfuric acid and no bleach was added.

Example 1 shows, in comparison with example 2, that the one-stage bleaching $D/P_{cat}$ according to the invention achieves delignification and bleaching which are just as pronounced as with the $DP_{cat}$ bleaching disclosed in U.S. Pat. No. 6,048,437. This is surprising and not foreseeable from the prior art of U.S. Pat. No. 6,048,437 since, in the prior art, a synergistic effect of the simultaneous action of chlorine dioxide, hydrogen peroxide and molybdate is taught, which is said to lead to stronger bleaching compared with separate bleaching with chlorine dioxide and hydrogen peroxide. Example 3 shows that in the process according to the invention the sequence of addition of chlorine dioxide and hydrogen peroxide is important for the bleaching efficiency, which was likewise not foreseeable from the experimental data of U.S. Pat. No. 6,048,437.

TABLE 2

Two-stage bleaching of chemical pulp A with an O-bleach sequence

| Experiment | Stage | Chemical in % by weight | | | | Kappa factor | Time in min | Temperature in ° C. | pH | | Kappa number | Whiteness in % ISO |
|---|---|---|---|---|---|---|---|---|---|---|---|---|
| | | $H_2SO_4$ | $H_2O_2$ | Mo | $ClO_2$ | | | | Start | End | | |
| 1 | D/ | 0.3 | | | 0.76 | 0.20 | 15 | 90 | | | | |
| | $P_{cat}$ | | 1.0 | 0.05 | | | 120 | | | 3.1 | 1.6 | 73.4 |
| 2* | $DP_{cat}$ | 0.3 | 1.0 | 0.05 | 0.76 | 0.20 | 135 | 90 | | 2.9 | 1.7 | 73.1 |
| 3* | $P_{cat}$/ | 0.3 | 1.0 | 0.05 | | | 120 | 90 | | | | |
| | D | | | | 0.76 | 0.20 | 15 | | | 3.0 | 1.7 | 71.9 |

TABLE 2-continued

| Two-stage bleaching of chemical pulp A with an O-bleach sequence | | | | | | | | | | | | |
|---|---|---|---|---|---|---|---|---|---|---|---|---|
| Experiment | Stage | Chemical in % by weight | | | | Kappa factor | Time in min | Temperature in ° C. | pH | | Kappa number | Whiteness in % ISO |
| | | $H_2SO_4$ | $H_2O_2$ | Mo | $ClO_2$ | | | | Start | End | | |
| 4* | $P_{cat}$ | 0.6 | 1.0 | 0.05 | | | 135 | 90 | 3.1 | 3.9 | 3.4 | 56.2 |
| 5* | D | | | | 0.76 | 0.20 | 135 | 90 | | 2.9 | 3.1 | 65.9 |
| 6* | | 0.8 | | | | | 135 | 90 | 2.8 | 3.0 | 6.4 | 52.6 |

*not according to the invention

Three-Stage Sequence with Bleaching Stage and $E_P$ Stage:

In examples 7 to 14, chemical pulp B was bleached with the amounts of chemicals mentioned in table 3 under the conditions mentioned in the table. The properties of the chemical pulp obtained are summarized in table 4.

Example 7 shows, in comparison with examples 9 to 12 not according to the invention, which were carried out with comparable amounts of bleaching agent, that the high delignification and bleaching unexpected from the prior art is also achieved in combination with a subsequent alkaline extraction stage $E_P$. Furthermore, the examples also show that in the bleaching stage according to the invention the oxidative degradation of cellulose is particularly low, recognizable from the high viscosity of the bleached chemical pulp, i.e. the bleaching stage according to the invention is particularly gentle to the fibers and therefore provides a chemical pulp with which papers having a higher breaking strength can be produced. In addition, an improvement in the stability of the chemical pulp to yellowing, recognizable from the lower post color number (PC number) after heat ageing, is achieved by the bleaching stage according to the invention.

Example 14 shows, in comparison with example 13 not according to the invention, that the bleaching stage according to the invention requires substantially less bleaching chemicals than a bleaching only with chlorine dioxide, in order to achieve the same degree of delignification, i.e. the same Kappa number, and the required amount of the chlorine dioxide can be reduced by 70%, which leads to a corresponding reduction in the formation of undesired organochlorine compounds.

TABLE 3

| Three-stage bleaching of chemical pulp B with an O-bleach-$E_P$ sequence | | | | | | | | | | | |
|---|---|---|---|---|---|---|---|---|---|---|---|
| Experiment | Stage | Chemical in % by weight | | | | | Kappa factor | Time in min | Temperature in ° C. | pH | |
| | | $H_2SO_4$ | NaOH | $H_2O_2$ | Mo | $ClO_2$ | | | | Start | End |
| 7 | $D/P_{cat}$ | 0.85 | | | | 0.60 | 0.15 | 15 | 90 | | |
| | | | | 0.5 | 0.05 | | | 105 | | | 2.6 |
| | $E_P$ | | 1.2 | 0.4 | | | | 60 | 80 | 12.0 | 10.9 |
| 8* | $DP_{cat}$ | 0.85 | | 0.5 | 0.05 | 0.60 | 0.15 | 120 | 90 | | 2.9 |
| | $E_P$ | | 1.2 | 0.4 | | | | 60 | 80 | 12.0 | 10.9 |
| 9* | $P_{cat}/D$ | 0.85 | | 0.5 | 0.05 | | | 105 | 90 | | |
| | | | | | | 0.60 | 0.15 | 15 | | | 2.8 |
| | $E_P$ | | 1.2 | 0.4 | | | | 60 | 80 | 11.9 | 10.9 |
| 10* | $P_{cat}/D$ | 0.85 | | 0.5 | 0.05 | 0.60 | 0.15 | 15 | 90 | | 2.9 |
| | | | | | | | | 105 | | | |
| | $E_P$ | | 1.2 | 0.4 | | | | 60 | 80 | 12.0 | 10.8 |
| 11* | D | 0.85 | | | | 0.60 | 0.15 | 120 | 90 | | 2.4 |
| | $E_P$ | | 1.2 | 0.4 | | | | 60 | 80 | 10.7 | 10.7 |
| 12* | $P_{cat}$ | 1.0 | | 0.5 | 0.05 | | | 120 | 90 | | 3.0 |
| | $E_P$ | | 1.2 | 0.4 | | | | 60 | 80 | 12.0 | 10.9 |
| 13* | D | 0.75 | | | | 1.0 | 0.25 | 120 | 90 | | 2.5 |
| | $E_P$ | | 1.2 | 0.4 | | | | 60 | 80 | 11.9 | 10.9 |
| 14 | $D/P_{cat}$ | 0.3 | | | | 0.30 | 0.075 | 15 | 90 | | |
| | | | | 0.5 | 0.05 | | | 105 | | | 3.7 |
| | $E_P$ | | 1.2 | 0.4 | | | | 60 | 80 | 12.1 | 11.0 |

*not according to the invention

TABLE 4

| Three-stage bleaching of chemical pulp B with an O-bleach-$E_P$ sequence | | | | | | | | |
|---|---|---|---|---|---|---|---|---|
| | | | | | Moist heat ageing | | Dry heat ageing | |
| Experiment | Sequence | Kappa number | Whiteness in % ISO | Viscosity in mPa · s | Change in whiteness in percentage points | PC number | Change in whiteness in percentage points | PC number |
| 7 | $D/P_{cat}$-$E_P$ | 1.4 | 84.5 | 22.7 | −1.9 | 0.41 | −2.1 | 0.46 |
| 8* | $DP_{cat}$-$E_P$ | 1.6 | 83.6 | 19.9 | −1.8 | 0.42 | −2.1 | 0.49 |
| 9* | $P_{Cat}/D$-$E_P$ | 1.5 | 82.5 | 22.1 | −2.1 | 0.53 | −2.3 | 0.59 |
| 10* | $P_{cat}/D$-$E_P$ | 1.7 | 81.9 | 20.7 | −2.0 | 0.53 | −1.9 | 0.50 |

TABLE 4-continued

Three-stage bleaching of chemical pulp B with an O-bleach-$E_P$ sequence

| Experiment | Sequence | Kappa number | Whiteness in % ISO | Viscosity in mPa · s | Moist heat ageing: Change in whiteness in percentage points | Moist heat ageing: PC number | Dry heat ageing: Change in whiteness in percentage points | Dry heat ageing: PC number |
|---|---|---|---|---|---|---|---|---|
| 11* | D-$E_P$ | 2.7 | 82.7 | 21.7 | −2.5 | 0.64 | −2.2 | 0.55 |
| 12* | $P_{cat}$-$E_P$ | 3.2 | 71.9 | 21.4 | −1.7 | 0.83 | −1.9 | 0.94 |
| 13* | D-$E_P$ | 2.2 | 84.9 | 19.3 | −2.3 | 0.49 | −2.5 | 0.54 |
| 14* | D/$P_{cat}$-$E_P$ | 2.2 | 82.7 | 21.2 | −2.7 | 0.69 | −1.7 | 0.42 |

*not according to the invention

Five-Stage Sequence O-Bleaching Stage-$E_P$-D-P:

In examples 15 and 16, chemical pulp C and, in examples 17 to 20, chemical pulp E was bleached with the amounts of chemicals mentioned in table 5 under the conditions mentioned in the table. The properties of the chemical pulp obtained are summarized in table 6.

Examples 15 (according to the invention) and 16 (not according to the invention) as well as 17 (according to the invention) and 18 (not according to the invention) show that, with a complete bleaching sequence comprising the bleaching stage D/$P_{cat}$ according to the invention and subsequent stages $E_P$-D-P according to the prior art, the same whiteness of more than 89.5% can be achieved with a smaller amount of chlorine dioxide than in a bleaching only with chlorine dioxide in a $D_0$-$E_P$-$D_1$-P sequence, with the use of less chlorine dioxide, and at the same time a chemical pulp having substantially improved stability to yellowing, recognizable from the lower post color number, is obtained.

Examples 19 and 20 show that with the bleaching stage according to the invention the same whiteness can also be achieved by bleaching at lower temperatures and hence with reduced energy consumption if the amount of molybdate is increased.

TABLE 5

Five-stage bleaching of chemical pulp C with an O-bleach-$E_P$-D-P sequence

| Experiment | Stage | Chemical in % by weight: $H_2SO_4$ | NaOH | $H_2O_2$ | Mo | $ClO_2$ | Kappa factor | Time in min | Temperature in ° C. | pH: Start | pH: End |
|---|---|---|---|---|---|---|---|---|---|---|---|
| 15 | D/$P_{cat}$ | 0.2 | | | | 0.29 | 0.075 | 15 | 90 | | |
| | | 0.05 | | 0.5 | 0.05 | | | 105 | | 12.0 | 2.6 |
| | $E_P$ | | 1.2 | 0.4 | | | | 60 | 80 | | 10.9 |
| | D | | | | | 0.11 | | 120 | 85 | | 4.9 |
| | P | | 0.7 | 0.5 | | | | 90 | 85 | 11.8 | 10.8 |
| 16* | D | 0.5 | | | | 0.59 | 0.15 | 120 | 90 | | 2.9 |
| | $E_P$ | | 1.2 | 0.4 | | | | 60 | 80 | 12.0 | 10.9 |
| | D | | | | | 0.08 | | 120 | 85 | | 5.1 |
| | P | | 0.7 | 0.5 | | | | 90 | 85 | 11.8 | 10.9 |
| 17 | D/$P_{cat}$ | 0.4 | | | | 0.57 | 0.15 | 15 | 90 | | |
| | | | | 0.5 | 0.05 | | | 105 | | | 3.0 |
| | $E_P$ | | 1.2 | 0.4 | | | | 60 | 80 | 11.9 | 10.8 |
| | D | 0.15 | | | | 0.23 | | 120 | 80 | | 4.1 |
| | P | | 0.6 | 0.4 | | | | 60 | 80 | 11.6 | 10.6 |
| 18* | D | 0.4 | | | | 0.78 | 0.20 | 120 | 90 | | 2.8 |
| | $E_P$ | | 1.2 | 0.4 | | | | 60 | 80 | 12.1 | 10.9 |
| | D | 0.15 | | | | 0.23 | | 120 | 80 | | 4.5 |
| | P | | 0.6 | 0.4 | | | | 60 | 80 | 11.6 | 10.6 |
| 19 | D/$P_{cat}$ | 0.4 | | | | 0.57 | 0.15 | 15 | 80 | | |
| | | | | 0.5 | 0.10 | | | 105 | | | 3.2 |
| | $E_P$ | | 1.2 | 0.4 | | | | 60 | 80 | 12.0 | 11.0 |
| | D | 0.15 | | | | 0.23 | | 120 | 80 | | 4.1 |
| | P | | 0.6 | 0.4 | | | | 60 | 80 | 11.5 | 10.6 |
| 20 | D/$P_{cat}$ | 0.4 | | | | 0.57 | 0.15 | 15 | 70 | | |
| | | | | 0.5 | 0.15 | | | 105 | | | 3.2 |
| | $E_P$ | | 1.2 | 0.4 | | | | 60 | 80 | 12.0 | 10.8 |
| | D | 0.15 | | | | 0.23 | | 120 | 80 | | 4.1 |
| | P | | 0.6 | 0.4 | | | | 60 | 80 | 11.5 | 10.6 |

*not according to the invention

TABLE 6

Five-stage bleaching of chemical pulp C with an O-bleach-$E_P$-D-P sequence

| Experiment | Stage | Kappa number | Whiteness in % ISO | Moist heat ageing: Change in whiteness in percentage points | Moist heat ageing: PC number | Dry heat ageing: Change in whiteness in percentage points | Dry heat ageing: PC number |
|---|---|---|---|---|---|---|---|
| 15 | $D/P_{cat}$ | | | | | | |
| | $E_P$ | 2.2 | | | | | |
| | D | | | | | | |
| | P | | 89.9 | −2.1 | 0.28 | −1.7 | 0.22 |
| 16* | D | | | | | | |
| | $E_P$ | 2.9 | | | | | |
| | D | | | | | | |
| | P | | 89.9 | −3.7 | 0.54 | −2.6 | 0.36 |
| 17 | $D/P_{cat}$ | | | | | | |
| | $E_P$ | 2.0 | | | | | |
| | D | | | | | | |
| | P | | 89.9 | −1.4 | 0.18 | −1.8 | 0.24 |
| 18* | D | | | | | | |
| | $E_P$ | 2.2 | | | | | |
| | D | | | | | | |
| | P | | 89.7 | −1.5 | 0.20 | −1.8 | 0.24 |
| 19 | $D/P_{cat}$ | | | | | | |
| | $E_P$ | 2.6 | | | | | |
| | D | | | | | | |
| | P | | 89.7 | −1.6 | 0.21 | −2.2 | 0.30 |
| 20 | $D/P_{cat}$ | | | | | | |
| | $E_P$ | 2.9 | | | | | |
| | D | | | | | | |
| | P | | 89.6 | −2.1 | 0.29 | −2.4 | 0.34 |

*not according to the invention

Four-Stage Sequence O-Bleaching Stage-$E_P$-D/P:

In examples 21 to 24, chemical pulp E was bleached with the amounts of chemicals mentioned in table 7 under the conditions mentioned in the table, with the use of the additional bleaching stage according to the invention. The properties of the chemical pulp obtained are summarized in table 8.

Example 21 shows, in comparison with examples 22 to 24 not according to the invention, that the advantages of the bleaching stage according to the invention, which were demonstrated in the preceding examples, are also achieved when in a complete bleaching sequence an additional bleaching stage D/P according to the invention, without washing between the bleaching with chlorine dioxide at acidic pH and with hydrogen peroxide at alkaline pH, is used instead of the usually employed bleaching stages D-P with intermediate washing.

TABLE 7

Four-stage bleaching of chemical pulp E with an O-bleach-$E_P$-D/P sequence

| Experiment | Stage | Chemical in % by weight: $H_2SO_4$ | NaOH | $H_2O_2$ | Mo | $ClO_2$ | Kappa factor | Time in min | Temperature in ° C. | pH: Start | pH: End |
|---|---|---|---|---|---|---|---|---|---|---|---|
| 21 | $D/P_{cat}$ | 0.5 | | | | 0.59 | 0.15 | 15 | 90 | | 3.0 |
| | | | | 0.5 | 0.05 | | | 105 | 90 | | 3.0 |
| | $E_P$ | | 1.1 | 0.5 | | | | 60 | 85 | 11.7 | 10.6 |
| | D/P | 0.1 | | | | 0.08 | | 10 | 85 | | 5.5 |
| | | | 0.7 | 0.5 | | | | 90 | 85 | 11.3 | 10.7 |
| 22* | $DP_{cat}$ | 0.5 | | 0.5 | 0.05 | 0.59 | 0.15 | 120 | 90 | | 3.1 |
| | $E_P$ | | 1.1 | 0.5 | | | | 60 | 85 | 11.7 | 10.6 |
| | D/P | 0.1 | | | | 0.08 | | 10 | 85 | | 5.5 |
| | | | 0.7 | 0.5 | | | | 90 | 85 | | 10.6 |
| 23* | $P_{cat}/D$ | 0.6 | | 0.5 | 0.05 | | | 105 | 90 | 3.5 | |
| | | | | | | 0.59 | 0.15 | 15 | 90 | | 3.0 |
| | $E_P$ | | 1.1 | 0.5 | | | | 60 | 85 | 11.6 | 10.5 |
| | D/P | 0.1 | | | | 0.08 | | 10 | 85 | | 5.7 |
| | | | 0.7 | 0.5 | | | | 90 | 85 | | 10.6 |
| 24 | D | 0.5 | | | | 0.78 | 0.25 | 120 | 90 | | 3.0 |
| | $E_P$ | | 1.1 | 0.5 | | | | 60 | 85 | 11.6 | 10.4 |
| | D/P | 0.1 | | | | 0.08 | | 10 | 85 | | 5.5 |
| | | | 0.7 | 0.5 | | | | 90 | 85 | | 10.6 |

*not according to the invention

TABLE 8

Four-stage bleaching of chemical pulp E with an O-bleach-$E_P$-D/P sequence

| Experiment | Whiteness in % ISO | Moist heat ageing: Change in whiteness in percentage points | Moist heat ageing: PC number | Dry heat ageing: Change in whiteness in percentage points | Dry heat ageing: PC number |
|---|---|---|---|---|---|
| 21 | 90.1 | −1.7 | 0.22 | −1.7 | 0.22 |
| 22* | 89.7 | −1.8 | 0.24 | −2.3 | 0.31 |
| 23* | 88.9 | −3.4 | 0.53 | −3.0 | 0.46 |
| 24* | 90.2 | −4.3 | 0.63 | −2.4 | 0.32 |

*not according to the invention

Bleaching Sequence O-D/$P_{Cat}$-$E_{OP}$-D/P:

In examples 25 and 26, chemical pulp F was bleached with the amounts of chemicals mentioned in table 9 under the conditions mentioned in the table using the additional bleaching stage according to the invention. The properties of the chemical pulp obtained are summarized in table 10.

Example 25 shows that with the bleaching stage according to the invention and the additional bleaching stage according to the invention a chemical pulp which has practically the same whiteness but in addition is substantially more stable to yellowing and is less oxidatively damaged is obtained compared with the most frequently used ECF bleaching sequence O-$D_0$-$E_{OP}$-$D_1$-P, with an amount of chlorine dioxide which is reduced by 38% and with saving of a bleaching stage, i.e. lower outlay in terms of apparatus.

TABLE 9

Bleaching of chemical pulp F with an $E_{OP}$ stage

| Experiment | Stage | Chemical in % by weight: $H_2SO_4$ | NaOH | $H_2O_2$ | Mo | $ClO_2$ | Kappa factor | Time in min | Temperature in ° C. | pH Start | pH End |
|---|---|---|---|---|---|---|---|---|---|---|---|
| 25 | D/$P_{cat}$ | 0.3 | | | | 0.61 | 0.125 | 15 | 90 | | 3.2 |
| | | | | 0.5 | 0.05 | | | 105 | 90 | | 3.5 |
| | $E_{OP}$ | | 1.0 | 0.35 | | | | 90 | 85 | | 10.4 |
| | D/P | 0.2 | | | | 0.19 | | 10 | 85 | | 4.5 |
| | | | 0.9 | 0.25 | | | | 90 | 85 | 11.1 | 10.7 |
| 26* | $D_0$ | 0.5 | | | | 0.98 | 0.20 | 100 | 90 | | 3.0 |
| | $E_{OP}$ | | 1.0 | 0.35 | | | | 90 | 85 | | 10.3 |
| | $D_1$ | 0.15 | | | | 0.19 | | 70 | 80 | | 4.5 |
| | P | | 0.4 | 0.25 | | | | 70 | 80 | 11.4 | 10.2 |

*not according to the invention

TABLE 10

Four-stage bleaching of chemical pulp F with an O-bleach-$E_{OP}$-D/P sequence

| Experiment | Stage | Kappa number | Whiteness in % ISO | Viscosity in mPa · s | Moist heat ageing: Change in whiteness in percentage points | Moist heat ageing: PC number | Dry heat ageing: Change in whiteness in percentage points | Dry heat ageing: PC number |
|---|---|---|---|---|---|---|---|---|
| 25 | D/$P_{cat}$ | | | | | | | |
| | $E_{OP}$ | 2.7 | | | | | | |
| | D/P | | 89.5 | 26.0 | −1.7 | 0.23 | −1.7 | 0.23 |
| 26* | $D_0$ | | | | | | | |
| | $E_{OP}$ | 2.7 | | | | | | |
| | $D_1$ | | | | | | | |
| | P | | 89.7 | 20.1 | −3.2 | 0.46 | −2.9 | 0.41 |

*not according to the invention

What is claimed is:

1. A process for delignifying and bleaching chemical pulp, comprising a bleaching stage, wherein:

a) in a first step, chemical pulp in a first aqueous mixture containing 3 to 30% by weight of said chemical pulp is reacted with chlorine dioxide in an amount corresponding to a Kappa factor in the range from 0.02 to 0.25, at a temperature of 50 to 150° C. and a pH in the range of from 2 to 7, until more than 90% of the chlorine dioxide has reacted, thereby forming a second aqueous mixture; and b) in a second step, the second aqueous mixture obtained in the first step is further reacted, without separating off constituents of the second aqueous mixture, with 0.1 to 5% by weight of hydrogen peroxide in the presence of a molybdate in an amount of 10 to 2,000 ppm of molybdenum or of a tungstate in an amount of 200 to 10,000 ppm of tungsten, at a temperature of 50 to 150° C. and a pH in the range of from 2 to 7, the amounts being based in each case on the mass of dry chemical pulp used, thereby forming a third aqueous mixture.

2. The process of claim 1, wherein the first and second steps are carried out at a temperature of 60 to 120° C.

3. The process of claim 1, wherein the first and second steps are carried out at a temperature of 70 to 90° C.

4. The process of claim 1, wherein the first aqueous mixture is reacted in the first step for 5 to 30 min.

5. The process of claim 1, wherein the first aqueous mixture is reacted in the first step for 10 to 20 min.

6. The process of claim 1, wherein the first aqueous mixture is reacted in the first step until the chlorine dioxide has completely reacted.

7. The process of claim 1, wherein the second aqueous mixture obtained in the first step is reacted with hydrogen peroxide in the second step for 60 to 180 min.

8. The process of claim 1, wherein the second aqueous mixture obtained in the first step is reacted with hydrogen peroxide in the second step for 90 to 120 min.

9. The process of claim 1, wherein the bleaching stage is carried out continuously in an apparatus comprising a riser tube and a bleaching tower, wherein a) the first aqueous mixture containing 3 to 30% by weight of chemical pulp is fed to the riser tube at the lower end, and the chlorine dioxide is added in the lower region of the riser tube;

b) after addition of the chlorine dioxide:

i) the first aqueous mixture flows through the riser tube in an ascending flow for 5 to 30 min during which time said second aqueous mixture is formed;

ii) the resulting second aqueous mixture is removed from the riser tube at the top and is fed to the bleaching tower at the top;

iii) the hydrogen peroxide is added to the second aqueous mixture in an upper region of the riser tube or at the top of the bleaching tower; and c) after addition of the hydrogen peroxide, the second aqueous mixture flows through the bleaching tower in a descending flow for 60 to 180 min during which time said third aqueous mixture is formed.

10. The process of claim 1, further comprising:

a) an extraction step, performed subsequent to said bleaching stage, comprising extracting the chemical pulp bleached in said bleaching stage with an aqueous alkaline solution;

b) subsequent to said extraction step, an additional bleaching stage comprising:

i) in a first step, reacting a fourth aqueous mixture containing 3 to 30% by weight of the chemical pulp extracted in extraction step a) with 0.04 to 0.4% by weight of chlorine dioxide, based on the mass of dry chemical pulp used, at a temperature of 50 to 150° C. and a pH in the range from 2 to 7 until at least 90% of the chlorine dioxide used has reacted, thereby forming a fifth aqueous mixture; and ii) in a second step, reacting the fifth aqueous mixture obtained in the first step, without separating off constituents of the mixture, with 0.1 to 5% by weight of hydrogen peroxide, based on the mass of dry chemical pulp used, at a temperature of 50 to 150° C. and a pH in the range from 10 to 12.5.

11. The process of claim 10, wherein, in the additional bleaching stage, the fifth aqueous mixture obtained in the first step is reacted in the second step for 60 to 180 min.

12. The process of claim 10, wherein, in the additional bleaching stage, the fifth aqueous mixture obtained in the first step is reacted in the second step for 90 to 120 min.

13. The process of claim 1, wherein an aqueous solution containing molybdate or tungstate is separated from the third aqueous mixture resulting from the second step of said bleaching stage, and molybdate or tungstate is separated from said solution by a process comprising:

a) bringing said aqueous solution containing molybdate or tungstate into contact with a water-insoluble, cationized inorganic support material at a pH of between 2 and 6 to give a support material laden with molybdate or tungstate and an aqueous solution depleted in molybdate or tungstate;

b) separating the support material laden with molybdate or tungstate from the aqueous solution depleted in molybdate or tungstate;

c) bringing the support material laden with molybdate or tungstate into contact with a second aqueous solution at a pH of between 6 and 14 to give a support material depleted in molybdate or tungstate and a second aqueous solution laden with molybdate or tungstate; and d) separating the support material depleted in molybdate or tungstate from the second aqueous solution laden with molybdate or tungstate.

14. The process of claim 13, wherein said second aqueous solution laden with molybdate or tungstate is recycled into the second step of the bleaching stage.

15. The process of claim 14, wherein a cationized phyllosilicate is used as the cationized inorganic support material.

16. The process of claim 14, wherein a bentonite ion-exchanged with a quaternary ammonium salt is used as the cationized inorganic support material.

* * * * *